US010286297B1

(12) United States Patent
Becker

(10) Patent No.: US 10,286,297 B1
(45) Date of Patent: May 14, 2019

(54) GAMING TABLE ASSEMBLY

(71) Applicant: David Becker, Silverdale, WA (US)

(72) Inventor: David Becker, Silverdale, WA (US)

( * ) Notice: Subject to any disclaimer, the term of this patent is extended or adjusted under 35 U.S.C. 154(b) by 0 days.

(21) Appl. No.: 15/920,516

(22) Filed: Mar. 14, 2018

(51) Int. Cl.
*A63F 9/04* (2006.01)
*A63F 11/00* (2006.01)
*A63F 9/06* (2006.01)

(52) U.S. Cl.
CPC ..... *A63F 11/00* (2013.01); *A63F 9/04* (2013.01); *A63F 9/0402* (2013.01); *A63F 2009/0404* (2013.01); *A63F 2009/0408* (2013.01); *A63F 2009/0623* (2013.01); *A63F 2009/0625* (2013.01)

(58) Field of Classification Search
CPC .. A63F 9/04; A63F 9/0402; A63F 2009/0404; A63F 2009/0623; A63F 2009/0625; A63F 2003/00895; A63F 2003/00974; A63F 2009/0408
USPC ..... 273/144 R, 145 R, 309, 287, 241, 268, 273/148 R
See application file for complete search history.

(56) References Cited

U.S. PATENT DOCUMENTS 1,492,324 A * 4/1924 Hoover ..... G09F 19/10 312/114
1,692,943 A * 11/1928 Lelyveld ..... A43D 1/025 359/872
3,779,554 A * 12/1973 Brix ..... A63F 3/00895 273/242
4,146,229 A * 3/1979 Morse ..... A63F 1/10 273/150
4,247,114 A * 1/1981 Carroll ..... A63F 3/00157 273/146
4,807,883 A * 2/1989 Silverman ..... A63F 9/04 273/145 C
4,867,511 A * 9/1989 Katz ..... A47B 67/005 312/227
4,893,816 A 1/1990 Levy et al.
5,405,145 A 4/1995 Jones et al.
5,605,331 A 2/1997 Boe
5,959,791 A * 9/1999 Bagnato, III ..... G02B 7/182 248/466
7,334,792 B1 2/2008 Bermann
7,478,813 B1 * 1/2009 Hofferber ..... A63F 1/10 273/148 A
7,694,968 B2 * 4/2010 Sims, Jr. ..... G02B 27/022 273/148 R
7,918,456 B2 * 4/2011 Markov ..... A63F 1/06 273/148 A (Continued)

*Primary Examiner* — Benjamin Layno

(57) ABSTRACT

A gaming table assembly for entertainment includes a plate and a mirror. The plate is substantially transparent. The mirror is shaped substantially complementarily to the plate. A first frame is coupled to a perimeter of the plate. A second frame is coupled to a circumference of the mirror. A plurality of legs is coupled to and extends between the first frame and the second frame. The legs are configured to support the first frame and the second frame on a horizontal surface with the first frame positioned distally from the horizontal surface and the mirror facing upwardly. A plurality of multifaceted gaming pieces is configured to position on the plate so that a respective facet of each multifaceted gaming piece is positioned in contact with the plate. The mirror is positioned to view the respective facet so that the respective facet is incorporable into a game.

12 Claims, 3 Drawing Sheets

(56) References Cited

U.S. PATENT DOCUMENTS

| | | | |
|---|---|---|---|
| D655,950 | S | 3/2012 | Kvello |
| 2012/0211454 | A1 | 8/2012 | Wilson |

* cited by examiner

GAMING TABLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to table assemblies and more particularly pertains to a new table assembly for entertainment.

BRIEF SUMMARY OF THE INVENTION

An embodiment of the disclosure meets the needs presented above by generally comprising a plate and a mirror. The plate is substantially transparent. The mirror is shaped substantially complementarily to the plate. A first frame is coupled to a perimeter of the plate. A second frame is coupled to a circumference of the mirror. A plurality of legs is coupled to and extends between the first frame and the second frame. The legs are configured to support the first frame and the second frame on a horizontal surface with the first frame positioned distally from the horizontal surface and the mirror facing upwardly. A plurality of multifaceted gaming pieces is configured to position on the plate so that a respective facet of each multifaceted gaming piece is positioned in contact with the plate. The mirror is positioned to view the respective facet so that the respective facet is incorporable into a game.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
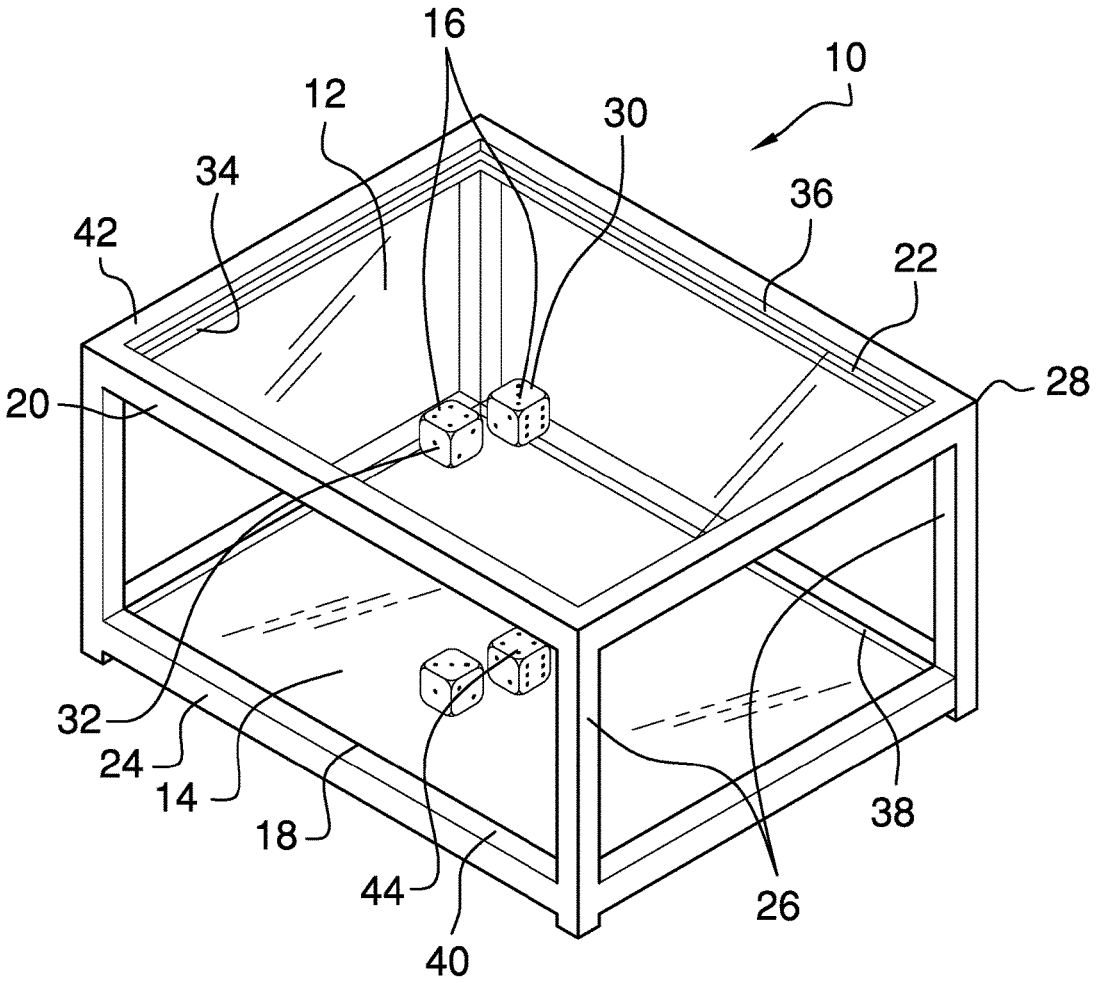
FIG. 1 is an isometric perspective view of a gaming table assembly according to an embodiment of the disclosure.
Figure 2:
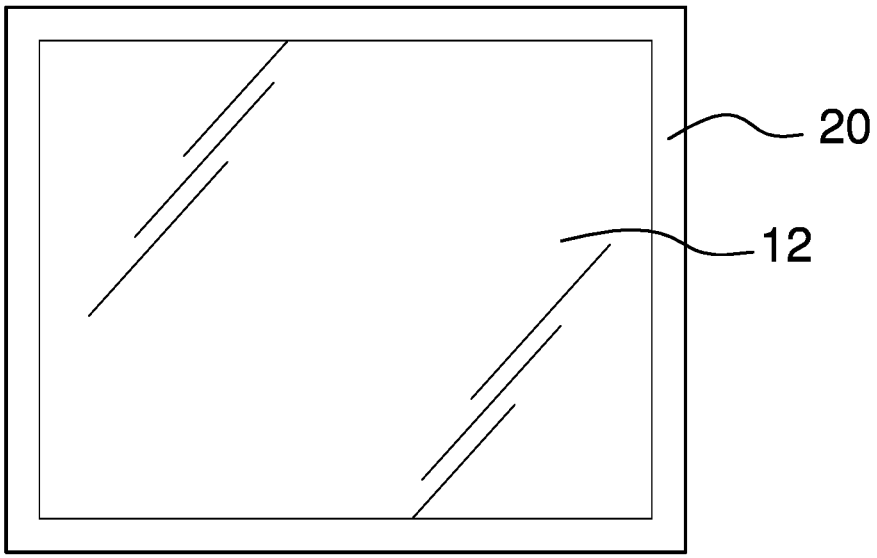
FIG. 2 is a top view of an embodiment of the disclosure.
Figure 3:
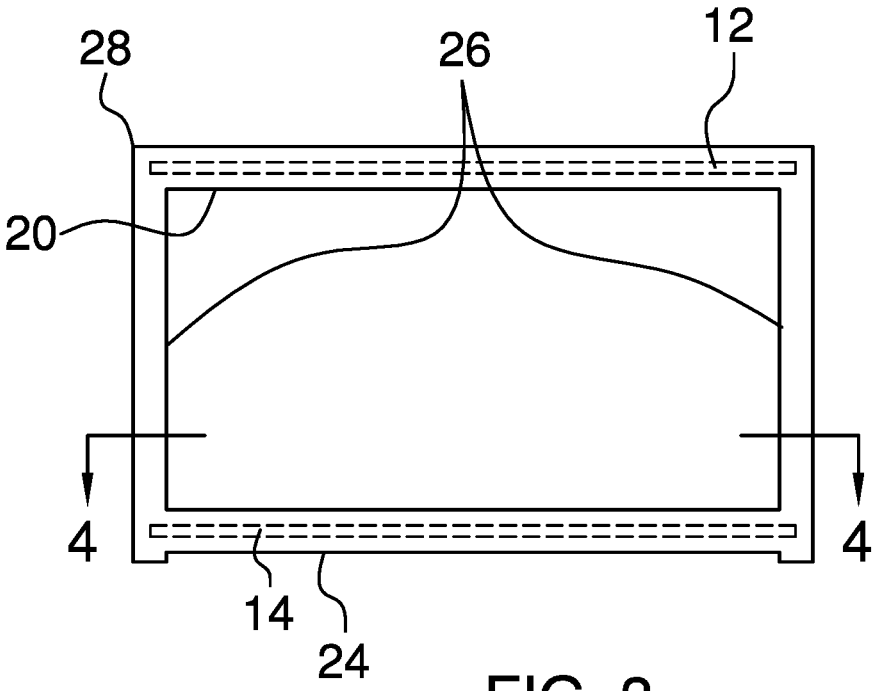
FIG. 3 is a side view of an embodiment of the disclosure.

With reference now to the drawings, and in particular to FIGS. 1 through 4 thereof, a new table assembly embodying the principles and concepts of an embodiment of the disclosure and generally designated by the reference numeral 10 will be described.

As best illustrated in FIGS. 1 through 4, the gaming table assembly 10 generally comprises a plate 12, a mirror 14, and a plurality of multifaceted gaming pieces 16. The plate 12 is substantially transparent. The plate 12 comprises poly(methyl 2-methylpropenoate) or the like. The plate 12 is substantially rectangularly shaped. The mirror 14 is shaped substantially complementarily to the plate 12. The mirror 14 has a circumference 18 that is beveled so that the mirror 14 is configured to be handled safely.

A first frame 20 is coupled to a perimeter 22 of the plate 12. A second frame 24 is coupled to the circumference 18 of the mirror 14. A plurality of legs 26 is coupled to and extends between the first frame 20 and the second frame 24. The legs 26 are configured to support the first frame 20 and the second frame 24 on a horizontal surface with the first frame 20 positioned distally from the horizontal surface and the mirror 14 facing upwardly.

Figure 4:
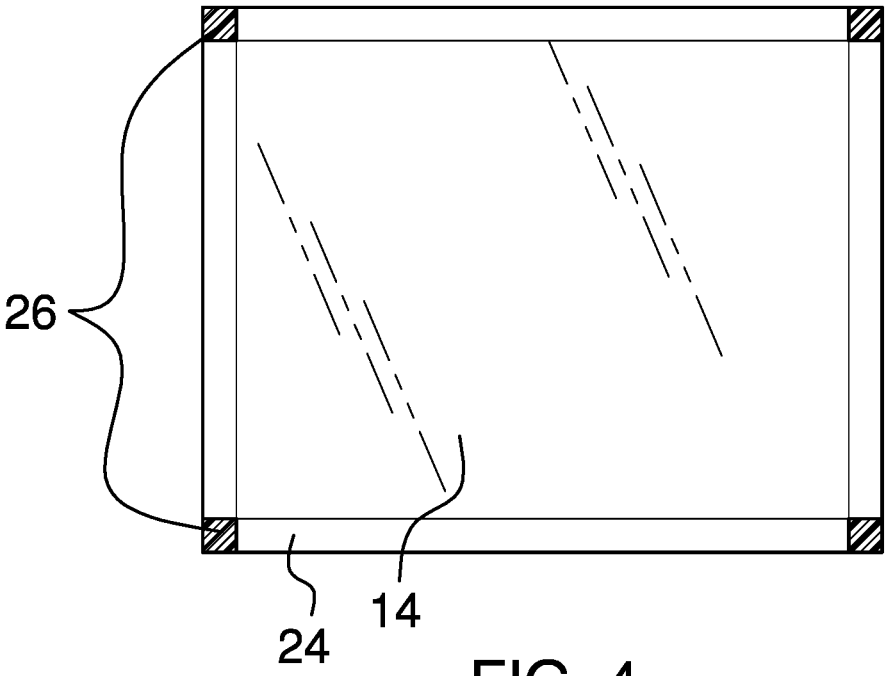
FIG. 4 is a cross-sectional view of an embodiment of the disclosure.

The plurality of legs 26 comprises four legs 26 that are positioned singly at each corner 28 of the first frame 20 as shown in FIG. 4. The legs 26 are squarely shaped when viewed longitudinally. Each leg 26 extends past the second frame 24, as shown in FIG. 1, so that the second frame 24 is positioned above the horizontal surface when the plurality of legs 26 is positioned on the horizontal surface.

The plurality of multifaceted gaming pieces 16 is selectively positionable on the plate 12 so that a facet 30 of each multifaceted gaming piece 16 is in contact with the plate 12. The facet 30 that is positioned on the plate 12 is visible to a user looking into the mirror 14, as shown in FIG. 1. The multifaceted gaming pieces 16 comprises dice 32.

A first recess 34 extends into a top 36 of the first frame 20. The first recess 34 is complementary to the perimeter 22 of the plate 12. The first recess 34 is positioned to insert the plate 12 to couple the plate 12 to the first frame 20.

A second recess 38 extends into an upper surface 40 of the second frame 24. The second recess 38 is complementary to the circumference 18 of the mirror 14. The second recess 38 is positioned to insert the mirror 14 to couple the mirror 14 to the second frame 24.

A lip 42 is coupled to and extends from the top 36 of the first frame 20 as shown in FIG. 1. The lip 42 is positioned to prevent the multifaceted gaming pieces 16 from departing the plate 12.

In one example of use, the dice 32 are configured to toss onto the plate 12. A respective facet 30 of each die 32 is positioned on the plate 12. The mirror 14 is positioned to view the respective facet 30 so that the respective facet 30 is incorporable into a game. The game includes rules that may comprise use of an opposing facet 44 in a mathematical manner, including subtraction, addition, and multiplication.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gaming table assembly comprising:

a plate, said plate being substantially transparent;

a mirror shaped substantially complementarily to said plate;

a first frame coupled to a perimeter of said plate, said first frame defining an uppermost surface of said gaming table assembly extending around said perimeter of said plate such that an upper surface of said plate is openly exposed within said first frame;

a second frame coupled to a circumference of said mirror;

a plurality of legs coupled to and extending between said first frame and said second frame wherein said legs are configured for rigidly supporting said first frame and said second frame on a horizontal surface with said first frame positioned distal from the horizontal surface and said mirror facing upwardly towards said plate, said mirror being rigidly fixed in a position parallel to and spaced from said plate by said plurality of legs, wherein the parallel position between the mirror and the plate remains fixed and non-adjustable; and a plurality of multifaceted gaming pieces selectively positionable on said plate such that a facet of each said multifaceted gaming piece is positioned on said plate such that said facet is visible to a user looking into said mirror; and wherein said multifaceted gaming pieces are configured for positioning on said plate such that a respective said facet of each said multifaceted gaming piece is in contact with said plate, wherein said mirror is positioned for viewing said respective said facet such that said respective said facet is incorporable into a game.

2. The assembly of claim 1, further including said plate comprising poly(methyl 2-methylpropenoate).

3. The assembly of claim 1, further including said circumference being beveled such that said mirror is configured for safe handling.

4. The assembly of claim 1, further including said plate being substantially rectangularly shaped.

5. The assembly of claim 4, further including said plurality of legs comprising four said legs positioned singly at each corner of said first frame.

6. The assembly of claim 1, further including said legs being squarely shaped when viewed longitudinally.

7. The assembly of claim 1, further including each said leg extending past said second frame such that said second frame is positioned above the horizontal surface when said plurality of legs is positioned on the horizontal surface.

8. The assembly of claim 1, further including said multifaceted gaming pieces comprising dice.

9. The assembly of claim 1, further including a first recess extending into a top of said first frame, said first recess being complementary to said perimeter of said plate such that said first recess is positioned for inserting said plate for coupling said plate to said first frame.

10. The assembly of claim 1, further including a second recess extending into an upper surface of said second frame, said second recess being complementary to said circumference of said mirror such that said second recess is positioned for inserting said mirror for coupling said mirror to said second frame.

11. The assembly of claim 1, further including a lip coupled to and extending from said top of said first frame wherein said lip is positioned for preventing said multifaceted gaming pieces from departing said plate.

12. A gaming table assembly comprising:

a plate, said plate being substantially transparent, said plate comprising poly(methyl 2-methylpropenoate), said plate being substantially rectangularly shaped;

a mirror shaped substantially complementarily to said plate, said mirror having a circumference, said circumference being beveled such that said mirror is configured for safe handling;

a first frame coupled to a perimeter of said plate, said first frame defining an uppermost surface of said gaming table assembly extending around said perimeter of said plate such that an upper surface of said plate is openly exposed within said first frame;

a second frame coupled to said circumference of said mirror;

a plurality of legs coupled to and extending between said first frame and said second frame wherein said legs are configured for rigidly supporting said first frame and said second frame on a horizontal surface with said first frame positioned distal from the horizontal surface and said mirror facing upwardly towards said plate, said mirror being rigidly fixed in a position parallel to and spaced from said plate by said plurality of legs, wherein the parallel position between the mirror and the plate remains fixed and non-adjustable, said plurality of legs comprising four said legs positioned singly at each corner of said first frame, said legs being squarely shaped when viewed longitudinally, each said leg extending past said second frame such that said second frame is positioned above the horizontal surface when said plurality of legs is positioned on the horizontal surface;

a plurality of multifaceted gaming pieces selectively positionable on said plate such that a facet of each said multifaceted gaming piece is positioned on said plate such that said facet is visible to a user looking into said mirror, said multifaceted gaming pieces comprising dice;

a first recess extending into a top of said first frame, said first recess being complementary to said perimeter of said plate such that said first recess is positioned for inserting said plate for coupling said plate to said first frame;

a second recess extending into an upper surface of said second frame, said second recess being complementary to said circumference of said mirror such that said second recess is positioned for inserting said mirror for coupling said mirror to said second frame;

a lip coupled to and extending from said top of said first frame wherein said lip is positioned for preventing said multifaceted gaming pieces from departing said plate; and wherein said dice are configured for tossing onto said plate such that a respective said facet of each said die is in contact with said plate, wherein said mirror is positioned for viewing said respective said facet such that said respective said facet is incorporable into a game.

* * * * *